US011325237B2

(12) United States Patent
Mojica

(10) Patent No.: US 11,325,237 B2
(45) Date of Patent: May 10, 2022

(54) MULTI-PURPOSE TOOL

(71) Applicant: Outdoor Element, LLC, Englewood, CO (US)

(72) Inventor: Michael John Mojica, Englewood, CO (US)

(73) Assignee: Outdoor Element, LLC, Englewood, CO (US)

( * ) Notice: Subject to any disclaimer, the term of this patent is extended or adjusted under 35 U.S.C. 154(b) by 0 days.

(21) Appl. No.: 17/161,381

(22) Filed: Jan. 28, 2021

(65) Prior Publication Data

US 2021/0229252 A1 Jul. 29, 2021

Related U.S. Application Data

(60) Provisional application No. 62/966,843, filed on Jan. 28, 2020.

(51) Int. Cl.

| | |
|---|---|
| ***B25B 15/00*** | (2006.01) |
| ***B25F 1/04*** | (2006.01) |
| ***B25F 1/00*** | (2006.01) |

(52) U.S. Cl.

CPC ..... *B25F 1/04* (2013.01); *B25F 1/006* (2013.01)

(58) Field of Classification Search

CPC ..... B25F 1/04; B25F 1/006
USPC ..... 7/165, 166, 167, 168
See application file for complete search history.

(56) References Cited

U.S. PATENT DOCUMENTS

| | | | | |
|---|---|---|---|---|
| 792,736 | A | 6/1905 | Sjastram | |
| 1,991,307 | A | 2/1935 | Worden | |
| 2,168,730 | A | 8/1939 | Cicchiello | |
| 2,663,076 | A * | 12/1953 | Robinson | B67B 7/24 30/446 |
| 2,727,415 | A | 12/1955 | Wendelken | |
| D543,432 | S * | 5/2007 | Rivera | A47J 45/10 D8/107 |
| 7,883,129 | B2 * | 2/2011 | Jung | A47J 45/10 294/34 |
| 8,807,387 | B2 * | 8/2014 | Montgelard | A47J 45/071 220/759 |
| 2011/0016733 | A1 * | 1/2011 | Peretti | B26F 1/32 30/361 |
| 2019/0174964 | A1 | 6/2019 | Lilljedahl et al. | |

OTHER PUBLICATIONS

International Search Report and Written Opinion issued in PCT/US2021/015540 dated Apr. 7, 2021.

"How to Recycle Your Fuel Canister" (Jetboil)[onlIne] (retrieved from the internet on Mar. 15, 2021) <URL https://www.youtube.com/watch?v=caQxXjsqmoo> (Uploaded Jun. 28, 2019).

* cited by examiner

*Primary Examiner* — Joseph J Hail
*Assistant Examiner* — Shantese L McDonald
(74) *Attorney, Agent, or Firm* — Holland & Hart LLP

(57) ABSTRACT

The invention relates is a multi-purpose utility tool. More specifically, the present invention provides an attachable handle for gripping pots and pans used in outdoor cooking. The attachable handle can be configured to connect to a fuel canister and prepare the fuel canister for disposal or recycling. The attachable handle can have a puncture tool to pierce the fuel canister. The connection of the attachable handle to the fuel canister can aid in the evacuation of fuel from the canister.

19 Claims, 19 Drawing Sheets

MULTI-PURPOSE TOOL

CROSS REFERENCES TO RELATED APPLICATIONS

This Application claims benefit to Provisional Application 62/966,843 filed on Jan. 28, 2020 for the invention disclosed herein, the contents of which are hereby incorporated by reference in their entirety.

TECHNICAL FIELD

The present application relates generally to a multi-purpose tool, and in particular to tool used for gripping camping cookware and disposing fuel canisters.

BACKGROUND

Many people enjoy the outdoors with cooking and camping. Portable camping stoves have long been used as a way to cook in remote locations. Many pots and pans have affixed handles that can heat up due to heat transfer while the stove flame is used to heat up the contents in the container. Accordingly, caution must be used when grabbing the handle to avoid burns. Fuel canisters are often used with portable stoves to heat up liquids and food in pots and pans. In addition, while these portable fuel canisters are convenient to use and bring on outdoor excursions, the canisters are pressurized and should be properly disposed to eliminate hazards associated with pressurized containers. For proper disposal, the canister should have all the gas evacuated. Once the gas is evacuated holes should be punctured into the wall of the canister to ensure the container is no longer pressurized.

BRIEF SUMMARY

According to an embodiment of the present disclosure of the attachment handle may include two handle bodies, a removable axis pin allowing the user to easily separate the handle sections, a nut with a pivoting axis with a stem to allow gas to expelled from a fuel canister, and a puncture tool. This attachable handle may be placed on outdoor pots or pans and allow the user to move and manipulate hot containers used for liquids and food. When the attachment handle can also be used to properly prepare portable fuel canisters for disposal or recycle.

A multi-use utility tool according to one aspect of the invention includes an upper handle having: a canister connector, a puncture device, at least one upper handle surface configured to contact a container. The tool also includes a lower handle having at least one lower handle surface configured to contact a container, where the multi-use utility tool has a closed configuration where the lower handle is pivotally connected to the upper handle and configured to releasably connect the at least one upper handle surface and at least one lower handle surface to a container, and where the multi-use utility tool has an open configuration where the canister connector is releasably attached to a fuel canister.

According to one aspect, the puncture device is configured to puncture the fuel canister in the open configuration. According to one aspect, the canister connector is pivotally connected to the upper handle. According to one aspect, the canister connector is a threaded connector. According to one aspect, the canister connector includes a center stem configured to release fuel from the fuel canister.

According to one aspect, the multi-use utility tool further includes a pin pivotally connecting the upper handle to the lower handle. According to one aspect, the pin is removed in the open configuration, where the upper handle is separated from the lower handle in the open configuration. According to one aspect, the lower handle is rotated about an axis of the pin in the open configuration such that the canister connector can releasably attach to the fuel canister.

According to one aspect, the upper handle further includes a top portion and two sidewall portions. According to one aspect, the puncture device is integrally formed in the top portion and where the puncture device extends distal to the two sidewall portions.

A releasable container handle according to one aspect of the invention includes a first handle body; a cavity formed in the handle body; a gripping portion located at one end of the first handle body, where the gripping portion is configured to removably grip a container; a canister connector pivotally mounted within the cavity, where the canister connector is configured to releasably attach to a fuel canister; a puncture tool located within the cavity, where the first handle body is configured to pivot about the canister connector to puncture the fuel canister with the puncture tool.

According to one aspect, the releasable container handle further includes a second handle body pivotally connected to the first handle body, where the gripping portion includes at least one first surface defined by the first handle body and at least one second surface defined by the second handle body. According to one aspect, the second handle body is removably connected to the first handle body.

According to one aspect, a second cavity is formed in the second handle body, and where the canister connector and the puncture tool are located within the second cavity. According to one aspect, the puncture tool is mounted within the cavity. According to one aspect, the puncture tool is formed in the first handle body. According to one aspect, the gripping portion includes a first flange formed in the handle body and a second flange formed in the first handle body. According to one aspect, the first flange defines a first surface and where the second flange defines a second surface. According to one aspect, the canister connector is a threaded connector. According to one aspect, the canister connector includes a center stem configured to release fuel from the fuel canister.

BRIEF DESCRIPTION OF DRAWINGS

The accompanying drawings, which are included to provide a further understanding of the embodiment and are incorporated in and constitute a part of this specification, illustrate embodiments of the disclosed device and together with the detailed description serve to explain the principles of the embodiment. In the drawings.

DETAILED DESCRIPTION

Embodiments are discussed in detail below. In describing embodiments, specific terminology is employed for the sake of clarity. However, the various embodiments are not intended to be limited to the specific terminology so selected. A person skilled in the relevant art would recognize that other equivalent parts can be employed and other methods developed without departing from the spirit and scope of the disclosure. All references cited herein are incorporated by references as if each had been individually incorporated.

Figure 1:
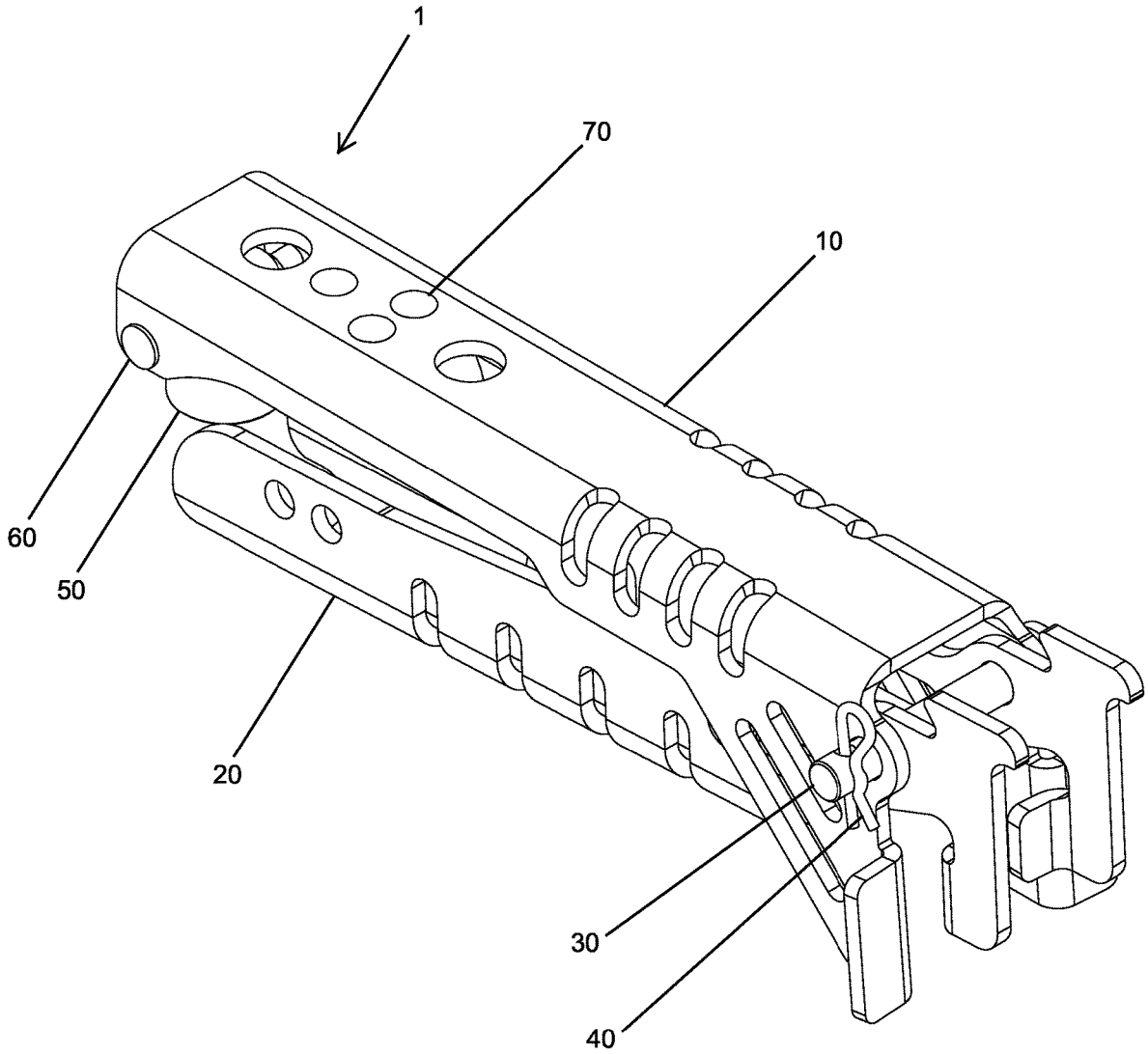
FIG. 1 shows a perspective view of the tool according to an embodiment of the disclosure.

FIG. 1 illustrates an embodiment of an attachable gripping handle 1 intended for outdoor cookware such as pots and pans. The attachable gripping handle 1 may include a first handle body 10 and a second handle body 20. The handle body 10 may include a cavity 15 formed within the first handle body 10. According to an embodiment, the first handle body 10 is an upper handle 10 and the second handle body is a lower handle body 20. When the upper handle 10 is compressed or squeezed toward the lower handle 20, the removable head axis pin 30, causes the head of the assembly to squeeze together and grip a camping pot or pan. According to an embodiment, the handle may be formed or constructed from a metal or plastic, such as, for example, but not limited to aluminum, carbon steel, stainless steel, polyethylene, other metals, other plastics, or other rigid materials, and combinations thereof. According to an embodiment, the handle may have different shapes, sizes, and construction methods.

Figure 2:
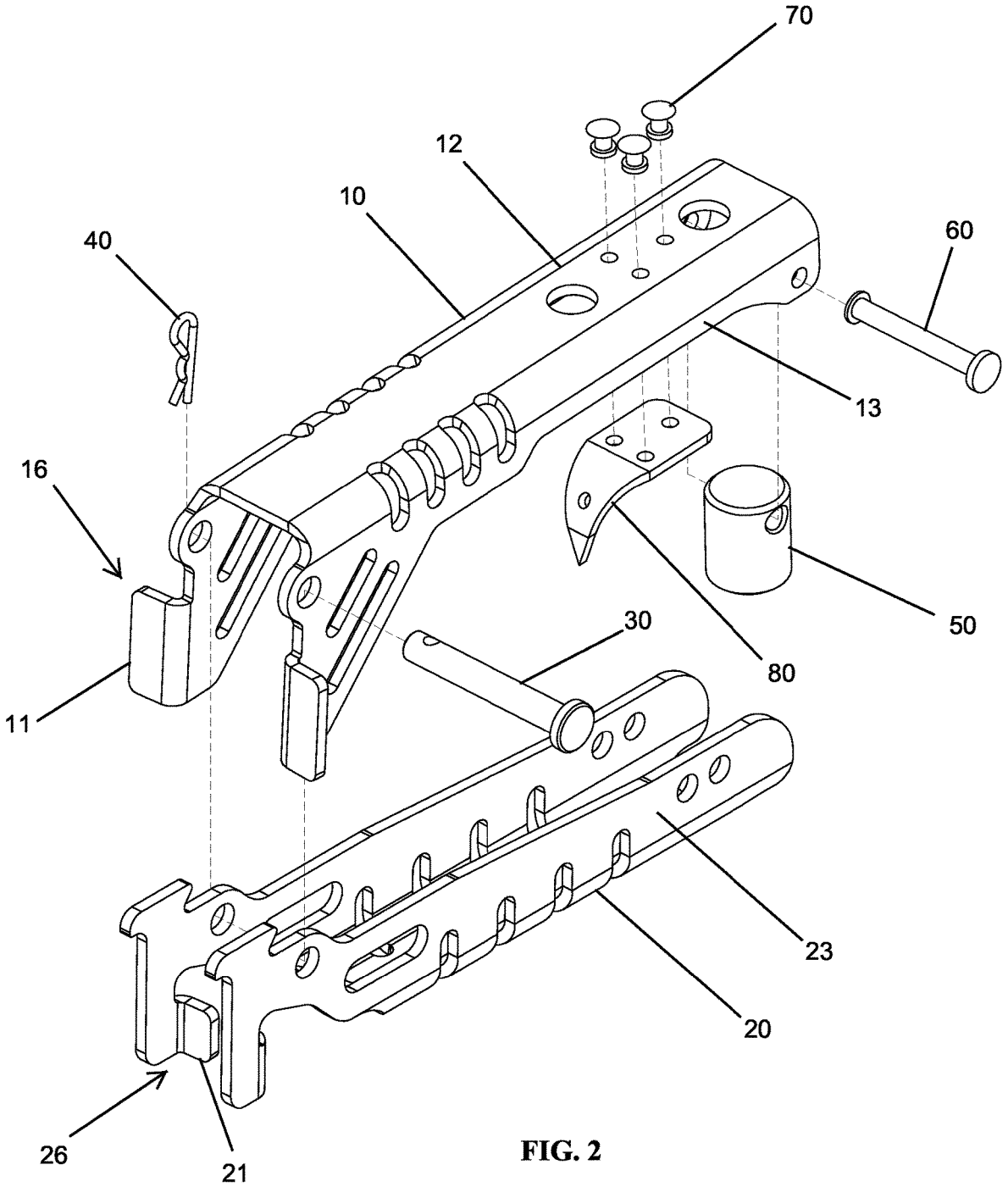
FIG. 2 shows an exploded perspective view of the tool of FIG. 1 according to an embodiment of the disclosure.

FIG. 2 illustrates an exploded assembly view of the attachable gripping handle 1. The upper handle 10 may include of a top portion 12 and at least two upper sidewall portions 13 connected to the top portion 12. The upper sidewall portions 13 may be substantially parallel to each other. The upper sidewall portions 13 may be substantially perpendicular to the top portion 12. According to an embodiment, the upper handle 10 may also include an upper gripping portion 16 located at one end of the upper handle 10 and a canister connector, for example a canister nut 50, located at an opposite end. The upper handle 10 may be rotationally affixed to the lower handle 20 with the head axis pin 30 at one end of the upper handle 10 and one end of lower handle 20. The lower handle 20 may include two lower sidewalls 23.

Figure 16:
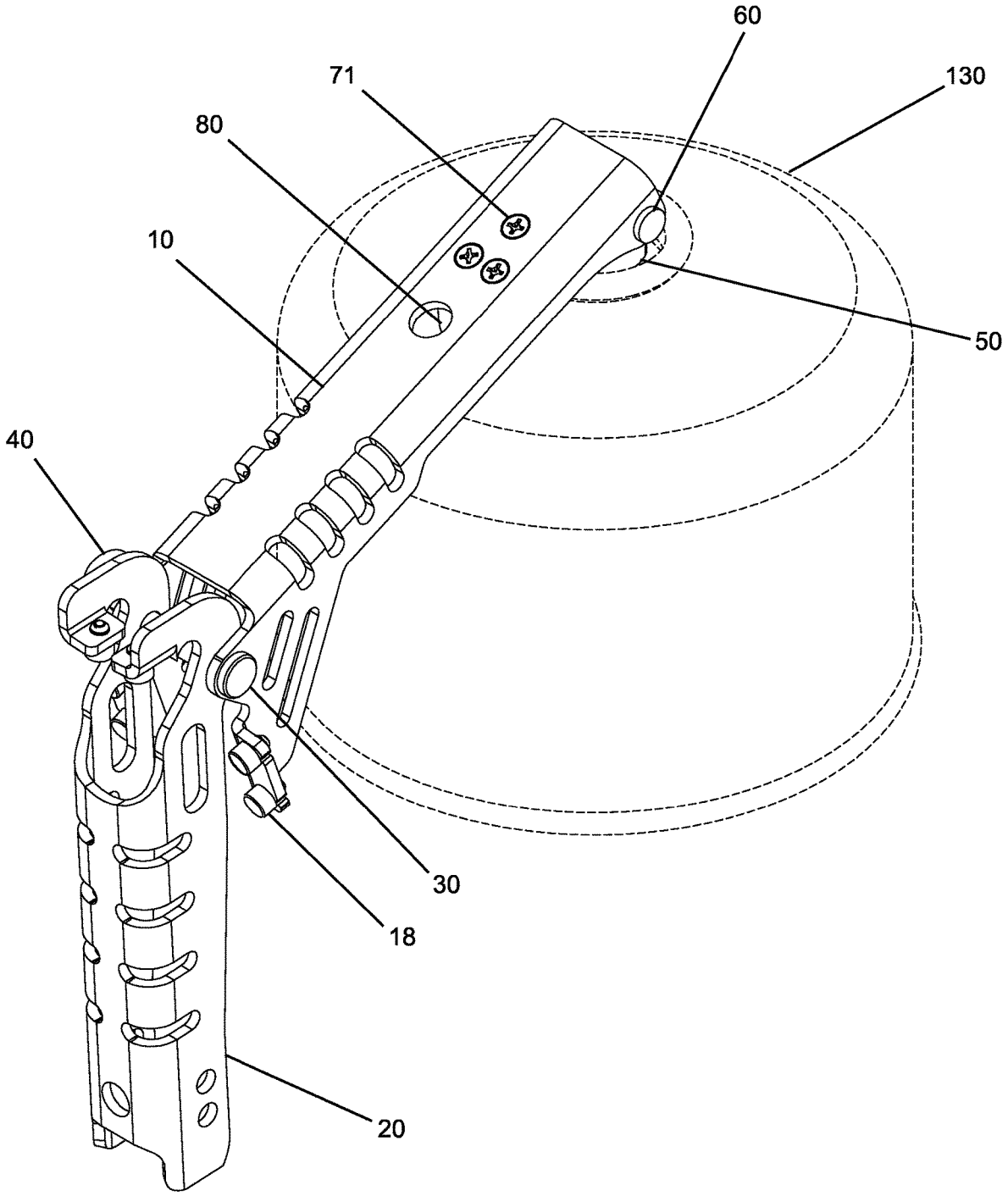
FIG. 16 shows a perspective view of the tool of FIG. 1 with a fuel canister according to an embodiment of the disclosure

The lower handle 20 may include of a bottom portion 22 and at least two lower sidewall portions 23 connected to the bottom portion 22. The lower sidewall portions 23 may be substantially parallel to each other. The lower sidewall portions 23 may be substantially perpendicular to the bottom portion 22. According to an embodiment, the lower handle 20 may also include a lower gripping portion 26 located at one end of the lower handle 20. The head axis pin 30 may be retained in place with the use of a removable cotter pin 40. This head axis pin 30 may be removable to allow the upper handle 10 to be separated from the lower handle 20 and used independently as fuel canister tool, which is explained in further detail below. A puncture tool 80, or for example a puncture device 80, may be attached to the upper handle 10, for example using rivets 70. Screws 71 and other attachment methods may also be used, as shown in FIG. 16. The canister nut 50 may be attached to the upper handle 10 with a rear axis pin 60. When the lower handle 20 is attached to upper handle 10, the entire assembly functions in a closed configuration as a pot or pan gripper. When the lower handle 20 is removed or rotated from the other components to create an open configuration, the upper handle acts as a fuel canister tool, which is explained in further detail below.

Figure 3:
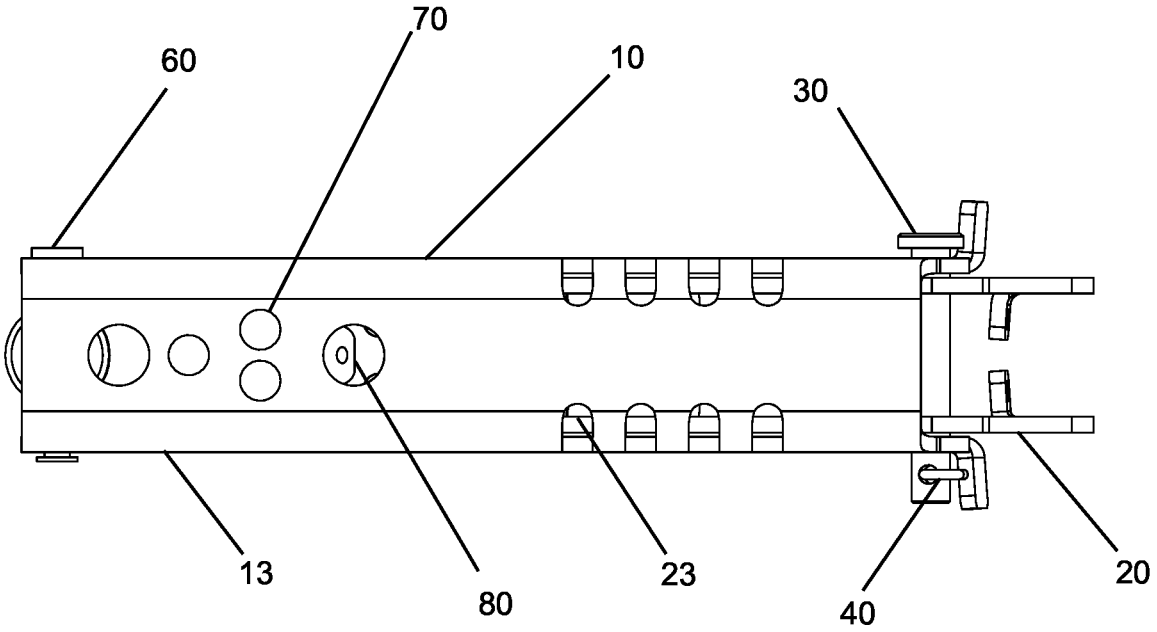
FIG. 3 shows a top view of the tool of FIG. 1 according to an embodiment of the disclosure.

FIG. 3 illustrates a top view of an embodiment of the current disclosure in the closed configuration. According to an embodiment, the puncture tool 80 may be secured between the upper and lower sidewalls 13, 23 of the handle. For example, the rivets 70 may be fastened through the top portion of the upper handle 10 and secure the puncture tool 80 between the upper and lower sidewalls 13, 23 of the handle.

Figure 4:
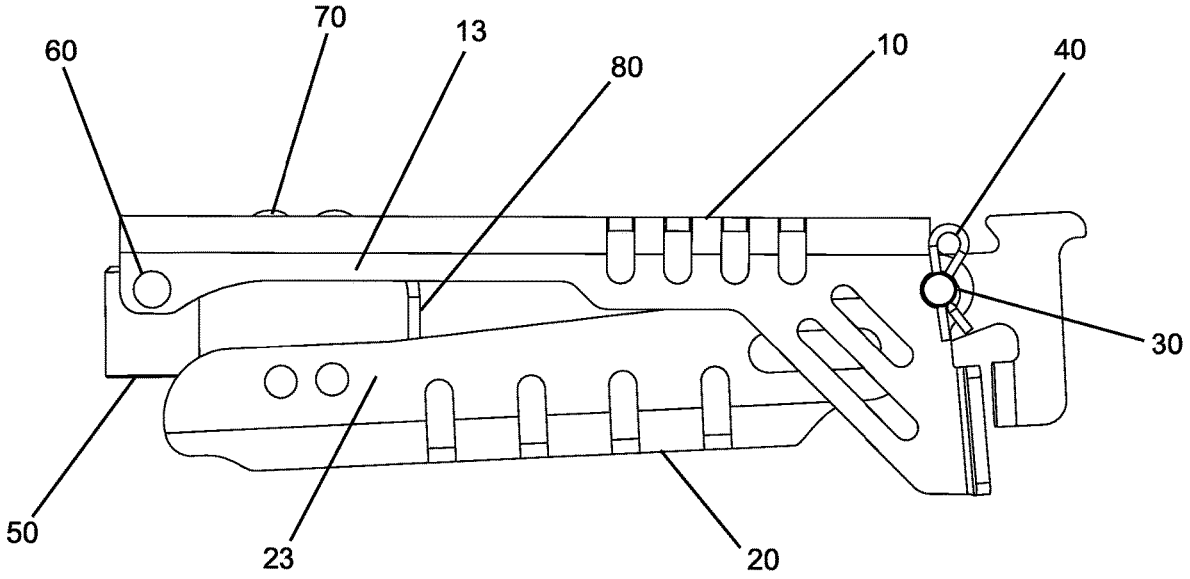
FIG. 4 shows a front view of the tool of FIG. 1 according to an embodiment of the disclosure.

FIG. 4 illustrates the front view of an embodiment of the current disclosure in the closed configuration. According to an embodiment, the puncture tool 80 may be contained within the upper handle 10 and the lower handle 20 in the closed configuration. For example, when the upper handle 10 and the lower handle 20 are rotated together in the closed configuration, the puncture tool 80 does not extend outwardly from the attachable gripping handle 1. According to an embodiment, the puncture tool 80 may extend only into a space enclosed by the upper handle 10 and the lower handle 20 and within upper and lower sidewalls 13, 23 of the handle. Accordingly, when the handle assembly is held by a user, the user's hand is protected from touching the puncture tool 80. The puncture tool 80 may extend distal to the upper sidewalls 13. The lower sidewalls 23 extend from the lower handle surface 27 at a distance greater than the puncture tool 80 to provide protection to the hand of the user while using the handle to grip a container, for example a pot or a pan, while in the closed configuration.

Figure 5:
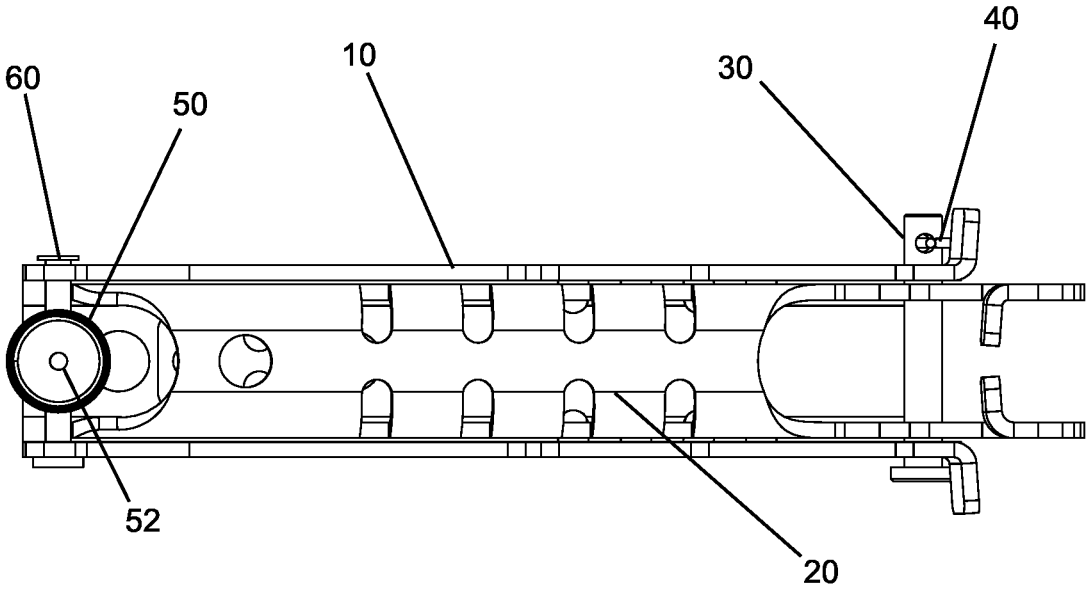
FIG. 5 shows a bottom view of the tool of FIG. 1 according to an embodiment of the disclosure.

FIG. 5 illustrates the bottom view of an embodiment of the current disclosure in the closed configuration. According to an embodiment, the lower handle 20 and lower sidewalls 23 may fit and rotate or pivot to be within the upper handle 10 and upper sidewalls 13 in the closed configuration. The head axis pin 30 may be assembled through the walls of the upper handle 10 and the lower handle 20. According to an embodiment, the head axis pin 30 may be secured to the upper handle 10 and the lower handle 20 with a cotter pin 40, such as a removable cotter pin. According to an embodiment, canister connector, for example the canister nut 50, may have a center stem 52 configured to depress a valve in a nipple of a fuel canister. The canister nut 50 may be configured to attach to a fuel canister. For example, the circumference of the canister nut 50 may have a threaded surface on its internal surface. According to an embodiment, the threaded surface of the canister nut 50 may be threaded onto a nipple of a fuel canister so that the center stem 52 may depress the fuel canister nipple and exhaust pressure from the fuel canister. According to an embodiment, the canister nut 50 connection to the fuel canister may also be configured to friction fit, snap fit, pressure seal or any other non-threaded connection onto a nipple of a fuel canister which may or may not be threaded. Other embodiments may include alternative structures for securing to a fuel canister. For example, the handle may attach to a ring on a fuel canister rather than directly to a valve. This may be through a structure other than a threaded canister nut, or an adapter attachable to the canister nut.

Figure 6:
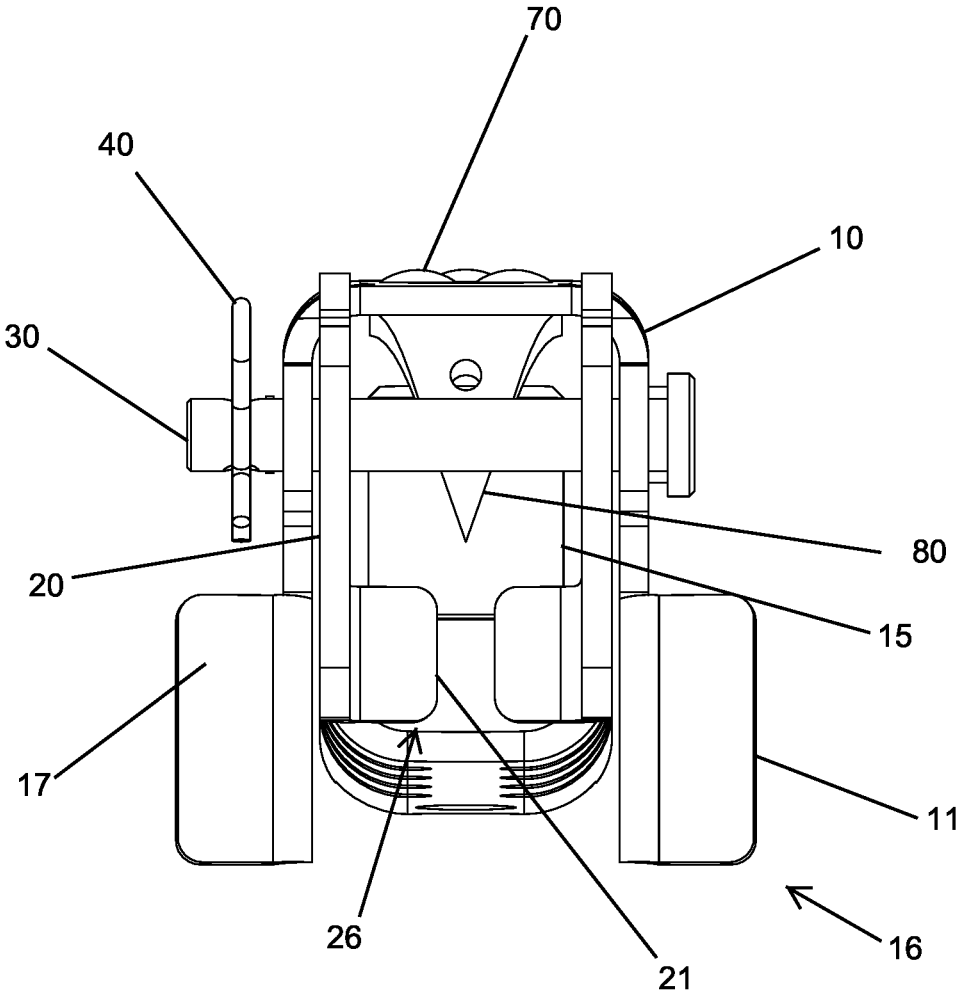
FIG. 6 shows a right view of the tool of FIG. 1 according to an embodiment of the disclosure.
Figure 7:
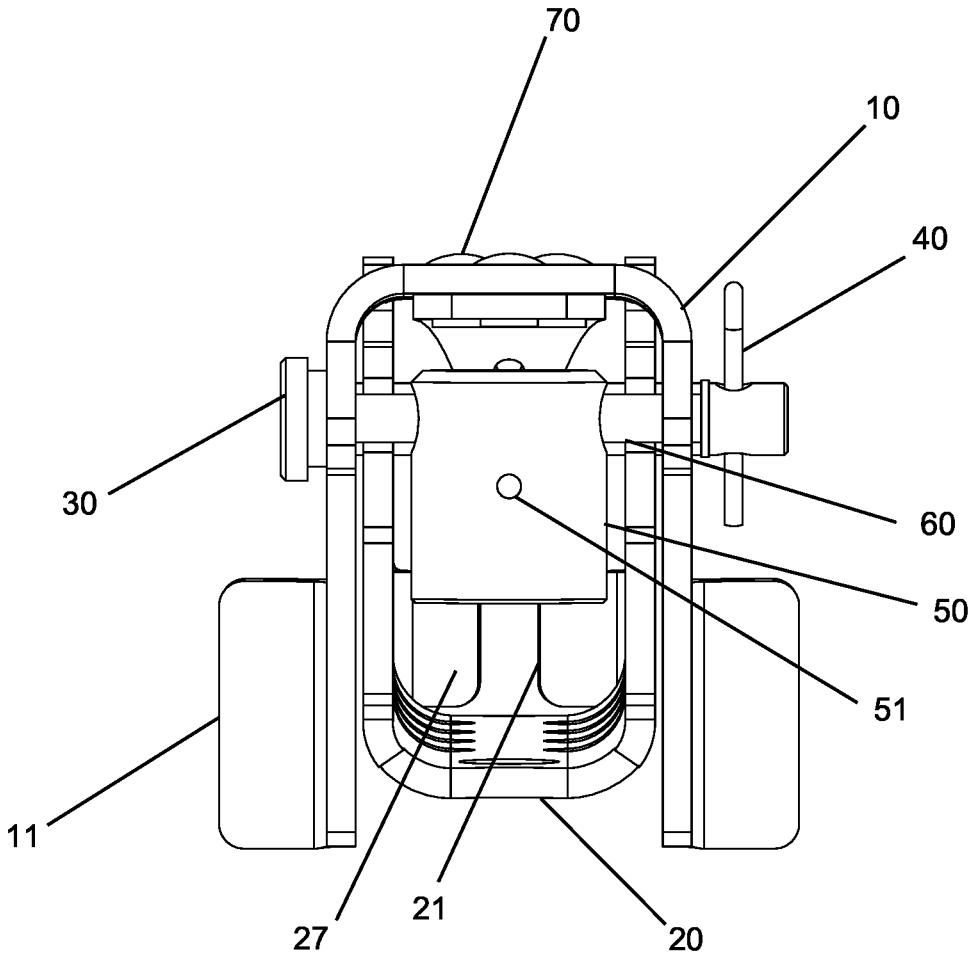
FIG. 7 shows a left view of the tool attachment of FIG. 1 according to an embodiment of the disclosure.
Figure 15:
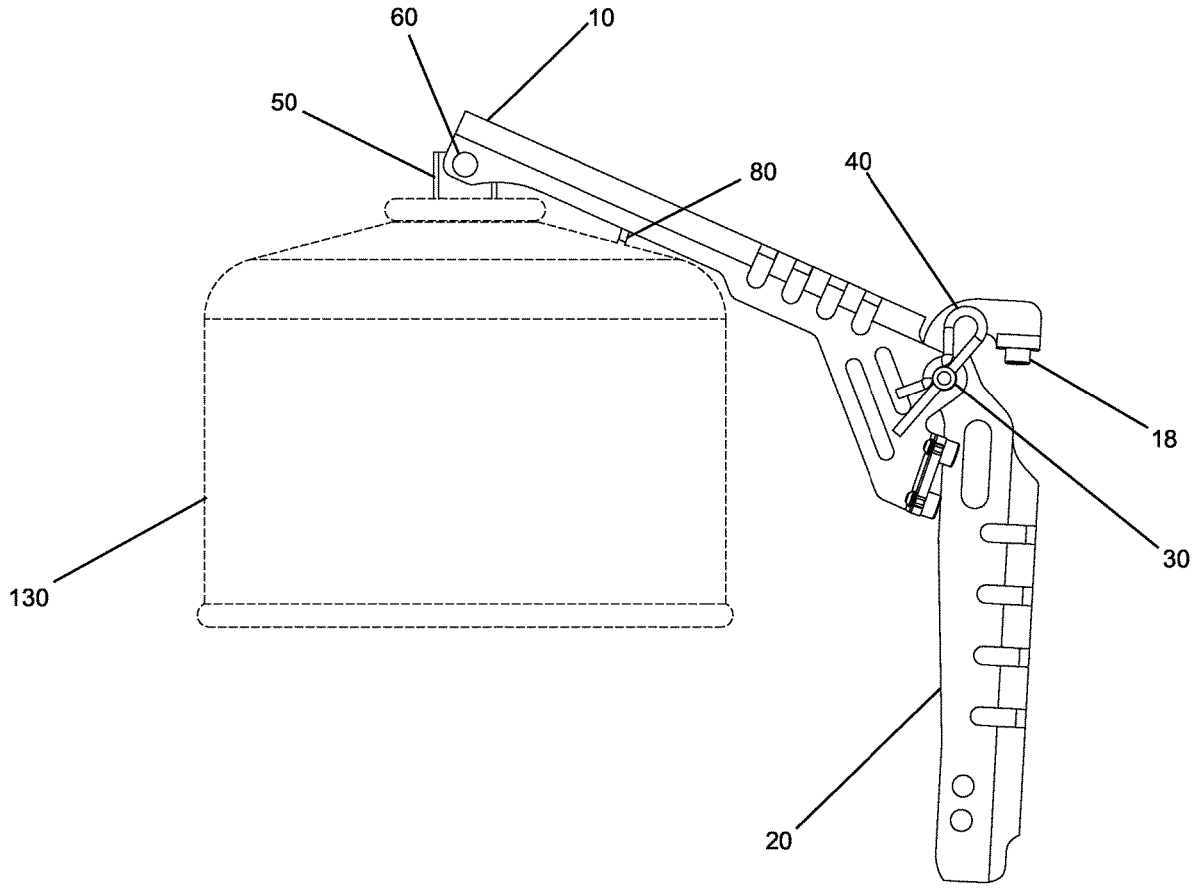
FIG. 15 shows a front view of the tool of FIG. 1 with a fuel canister according to an embodiment of the disclosure

FIG. 6 illustrates the right view of an embodiment of the current disclosure in the closed configuration. According to an embodiment, the upper handle 10 may have an upper gripping portion 16 including upper flanges 11 that project outwardly from the main body of the handle. The upper flanges 11 defining at least one upper handle surface 17. According to an embodiment, the upper flanges 11 define two upper handle surfaces 17. According to an embodiment, the lower handle 20 may have a lower gripping portion 26 having lower flanges 21 that project inwardly from the main body of the handle. The flanges 21 defining at least one lower handle surface 27, as shown in FIG. 7. According to an embodiment, the flanges 21 define two lower handle surfaces 27, as shown in FIG. 7. According to an embodiment, this flange configuration may allow the handle to have a sufficient surface area to grip and control a camping pot or pan for maneuvering. This illustrates an embodiment allowing the handle to grip a variety of sizes of containers, for example pots and pans. According to an embodiment, the handle may include other variations, for example silicone pads 18 may be attached to the upper and lower flanges 11, 21, as shown in FIG. 15 and FIG. 16. According to an embodiment, the silicone pads 18 may be located on only the upper flanges 11 or the silicone pads may be located only on lower flanges 21. According to an embodiment, the flanges may be formed to accept a receiver on a camp pot, and/or the handle may have a ratcheting mechanism for connecting and tightening to various camping pots and pans. According to an embodiment, the handle may include a locking mechanism, for example a ratcheting mechanism, to maintain the gripping handle in the closed position and securely connect to camping pots and pans.

FIG. 7 illustrates a left view of an embodiment of the current disclosure in the closed configuration displaying an orifice in the canister nut 50. When the nut is screwed on to the threaded nipple of a fuel canister, the orifice 51 will allow any remaining gas to evacuate the canister and through the orifice 51. The canister nut 50 may pivot freely about the rear axis pin 60 in between the walls of the upper handle 10 and the lower handle 20.

Figure 8:
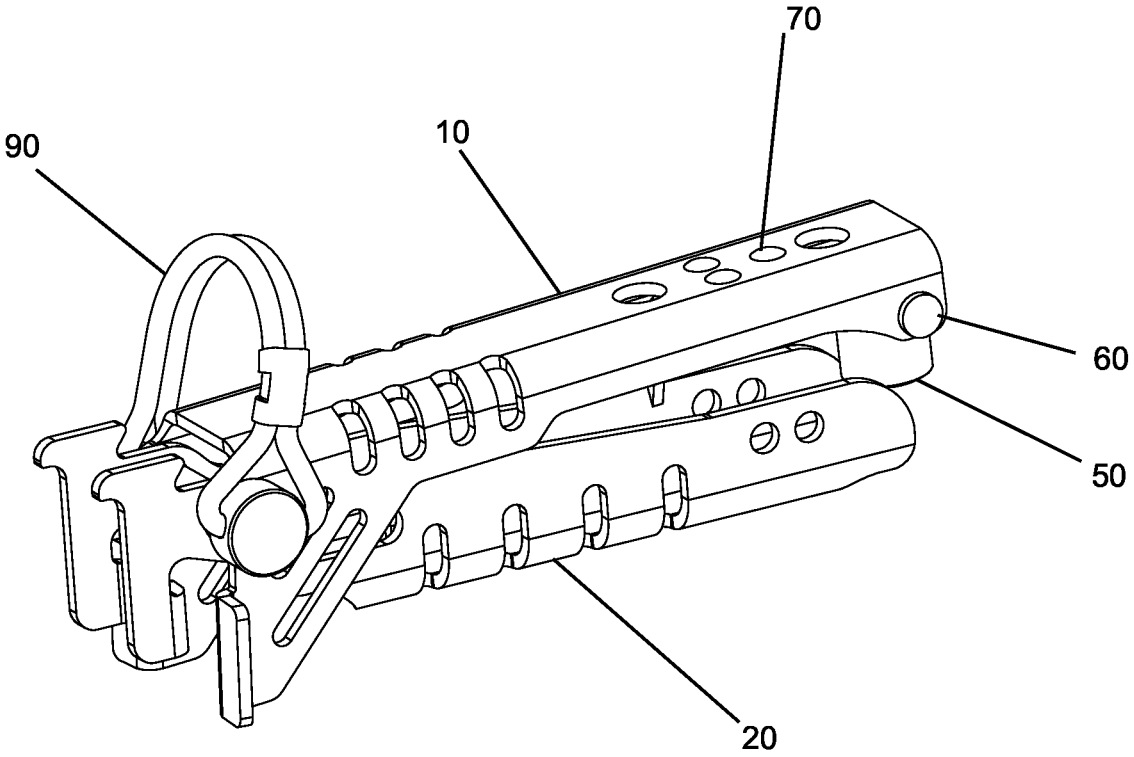
FIG. 8 shows a perspective view of a tool according to an embodiment of the disclosure.

FIG. 8 illustrates a perspective view of an embodiment of the current disclosure in the closed configuration with a clevis pin with a retainer wire 90 as an alternative embodiment of the head axis pin 30 and cotter pin 40. Other examples may include a quick release pin with a detent ball, a pin with a retaining ring groove, a pin with a threaded end, and other attachment members for rotational attachment. According to an embodiment, the clevis pin with retainer wire 90 may serve as an axis for the upper handle 10 and the lower handle 20 to pivot around. This embodiment is one example of a removable head axis pin. According to an embodiment, a cotter pin is not used.

Figure 9:
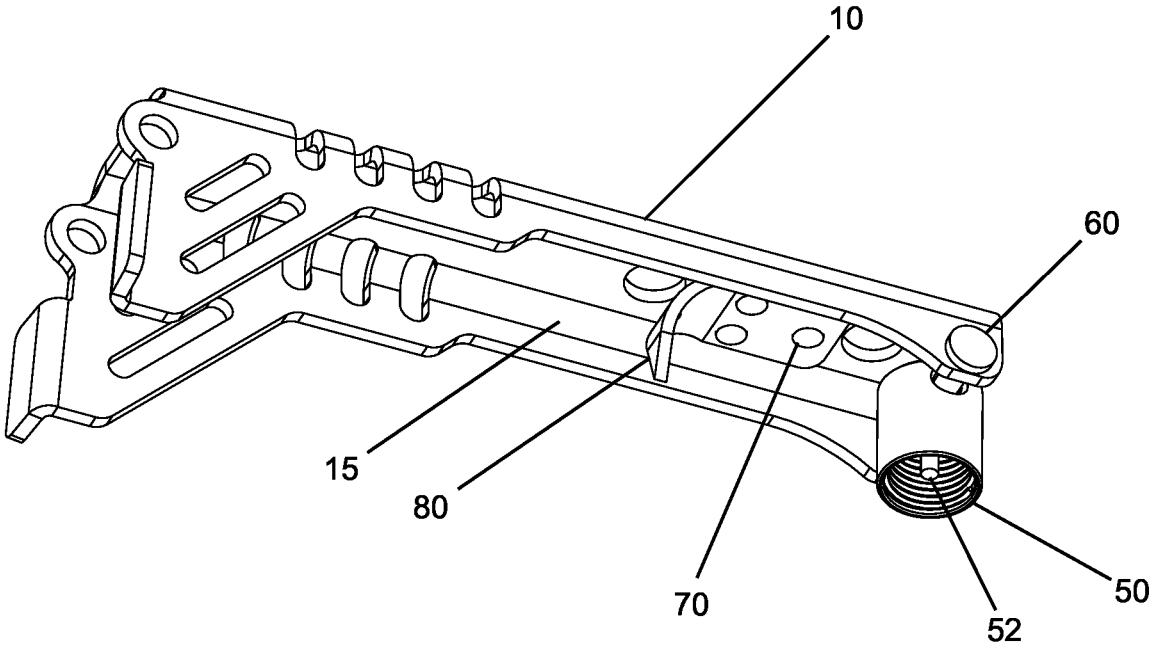
FIG. 9 shows a perspective view of a tool according to an embodiment of the disclosure.

FIG. 9 illustrates perspective view of an embodiment of the current disclosure in the open configuration with the lower handle 20 and head axis pin 30 removed. The remaining components illustrated are the upper handle 10, puncture tool 80, rivets 70, canister nut 50, and rear axis pin 60. According to an embodiment, in this configuration, the handle may be used as a disposal tool for fuel canisters. This embodiment exposes the puncture tool 80 and allows the user to attach the pivotable canister nut 50 to a fuel canister. This view also illustrates a center stem 52 in the center of the pivotable canister nut 50. When the pivotable canister nut 50 is attached to a fuel canister, the center stem 52 will depress the valve in the nipple the fuel canister and allow remaining gas to evacuate the canister.

Figure 10:
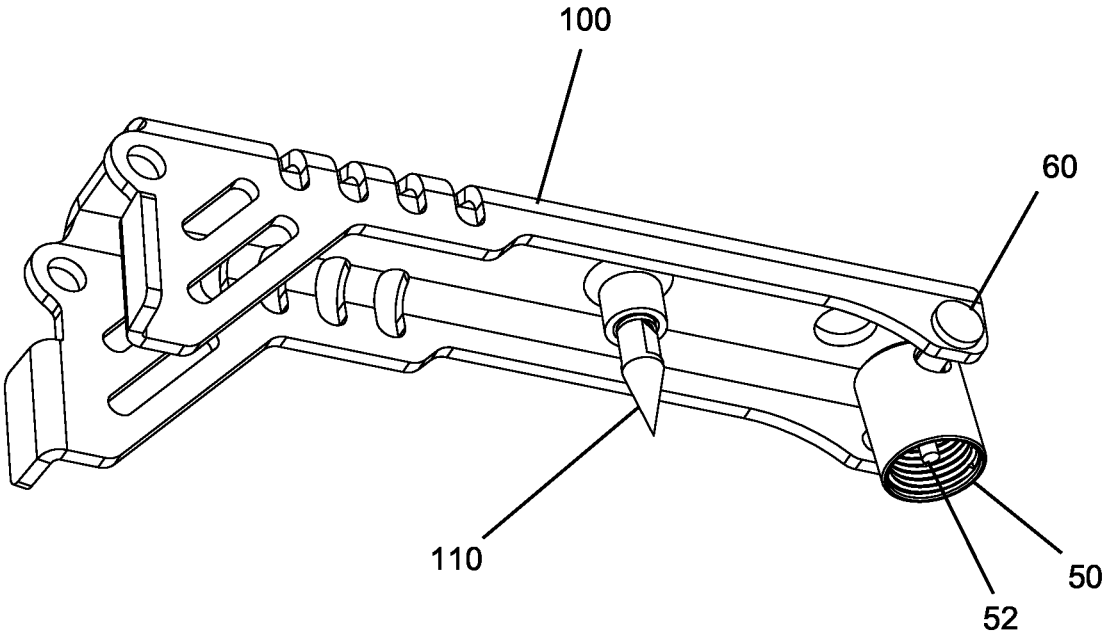
FIG. 10 shows a perspective view of a tool according to an embodiment of the disclosure.

FIG. 10 illustrates a perspective view of another embodiment of the current disclosure in the open configuration with the lower handle and head axis pin removed. The upper handle 100 has a threaded embossed feature allowing a threaded puncture point 110 to be assembled to the handle. According to an embodiment, the upper handle 100 may form an attachment portion for threaded puncture point 110 to attach to the upper handle 100. For example, the attachment portion may be an opening (such as for a friction fit with the threaded puncture point 110, or to adhesively attach the threaded puncture point 110), a threaded connector (such as a female threaded connector, or a male threaded connector), or other attachment mechanism for affixing the threaded puncture point 110. According to an embodiment, the puncture point 110 may be covered by a fitted cap (not shown).

Figure 11:
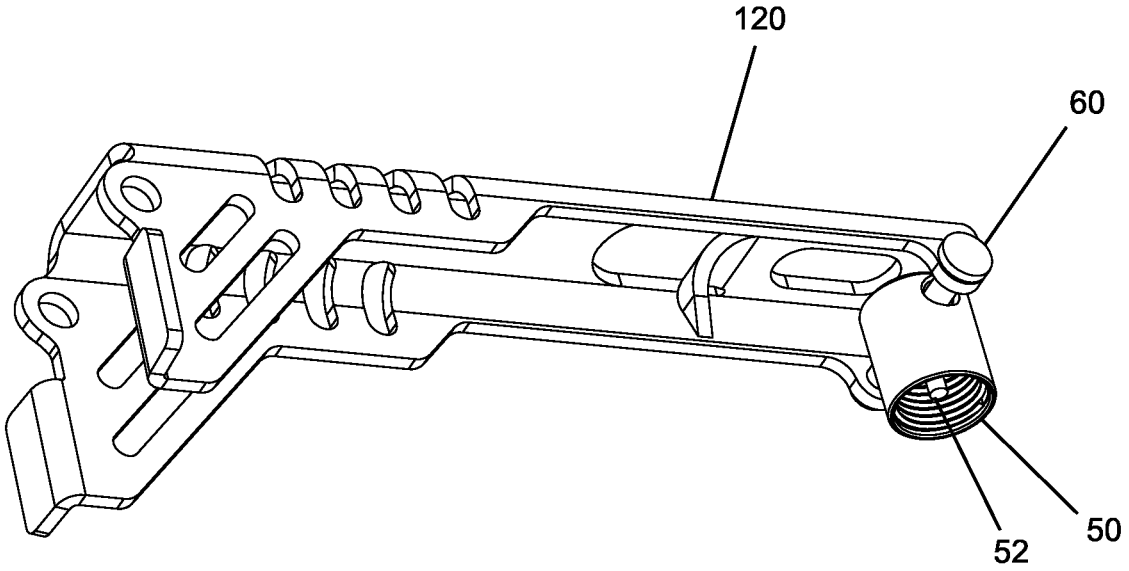
FIG. 11 shows a perspective view of a tool according to an embodiment of the disclosure.

FIG. 11 illustrates perspective view of another embodiment of the current disclosure in the open configuration. According to an embodiment, the upper handle 120 may include a formed puncture point integrally formed with the upper handle 120, or extending inwardly from the upper handle 120. In this embodiment, the upper handle 120 may be made from a material with sufficient strength to puncture the fuel canister, such as, for example, but not limited to steel, titanium, other sufficiently strong materials, or combinations thereof.

Figure 12:
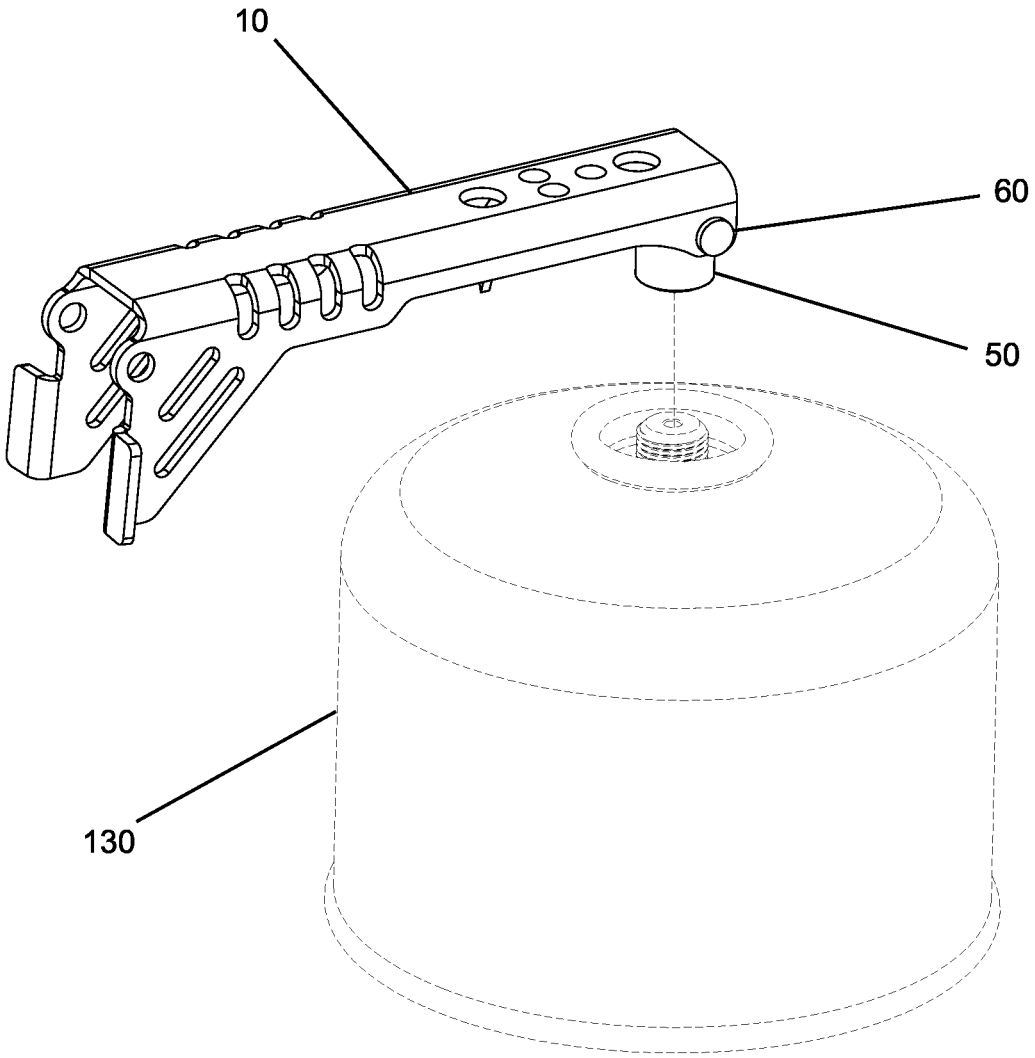
FIG. 12 shows an exploded perspective view of the tool of FIG. 9 with a fuel canister according to an embodiment of the disclosure.

FIG. 12 illustrates an exploded perspective view of an embodiment of the current disclosure in the open configuration showing orientation and alignment of the canister nut 50 engagement with a fuel canister 130. The canister nut 50 may have mating threads that draw the nut down and around the threaded nipple of the fuel canister 130 and allows gas to escape from the canister.

Figure 13:
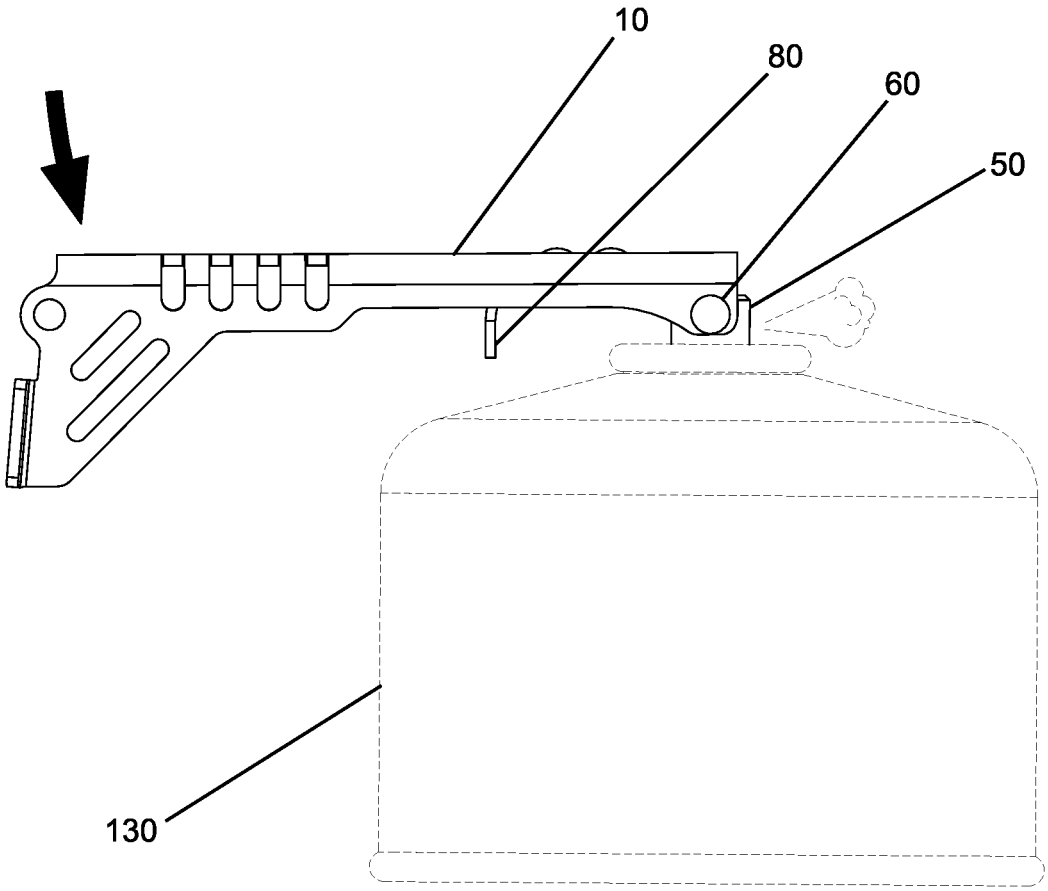
FIG. 13 shows a front view of the tool of FIG. 12 with a fuel canister according to an embodiment of the disclosure.

FIG. 13 illustrates a front view of an embodiment of the current disclosure in the open configuration engaged on a fuel canister 130. The canister nut 50 is fully engaged on the threaded nipple of the fuel canister 130 allowing gas to evacuate from the fuel canister 130. Once the canister is fully evacuated, the canister nut 50 and rear axis pin 60 allow the upper handle 10 to pivot down toward the fuel canister 130. The position of the puncture tool 80 is situated on the upper handle 10 so that the length of the upper handle 10 creates a mechanical advantage due to the moment arm when a force, designated with an arrow, is placed at the end of the upper handle 10. The mechanical advantage allows the puncture tool 80 to easily pivot and pierce the wall of the fuel canister.

Figure 14:
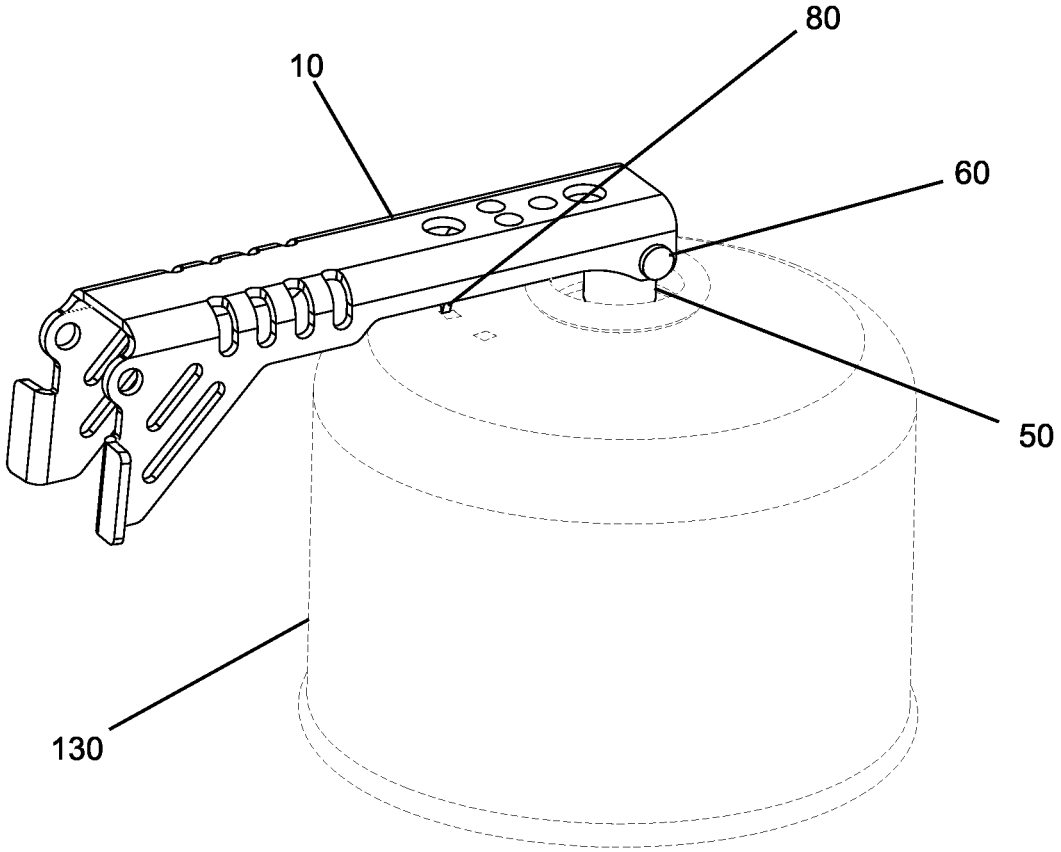
FIG. 14 shows a perspective view of the tool of FIG. 12 with a fuel canister according to an embodiment of the disclosure.

FIG. 14 illustrates a perspective view of an embodiment of the current disclosure in the open configuration engaged on and piercing the wall of a fuel canister 130. Because the disposal tool for fuel canisters has a threaded canister nut 50, the device can be rotated about the threaded nipple of the fuel canister 130 while maintaining threaded engagement with the threaded nipple of the fuel canister and used to make several punctures on the fuel canister 130 wall. Placing multiple piercings on the canister wall will ensure the canister is no longer pressurized and is ready for disposal or a recycle process.

FIG. 15 illustrates a front view of an alternative embodiment of the current disclosure in the open configuration engaged on a fuel canister 130. The lower handle 20 is rotated around head axis pin 30 to expose the puncture tool 80. The canister nut 50 is fully engaged on the threaded nipple of the fuel canister 130 allowing gas to evacuate from the fuel canister 130. Once the canister is fully evacuated, the canister nut 50 and rear axis pin 60 allow the upper handle 10 to pivot down toward the fuel canister 130. The position of the puncture tool 80 is situated on the upper handle 10 so that the length of the upper handle 10 creates a mechanical advantage due to the moment arm when a force, designated with an arrow, is placed at the end of the upper handle 10. The mechanical advantage allows the puncture tool 80 to easily pivot and pierce the wall of the fuel canister.

FIG. 16 illustrates a perspective view of the alternative embodiment shown in FIG. 15 engaged on and piercing the wall of a fuel canister 130. Because the disposal tool for fuel canisters has a threaded canister nut 50, the device can be rotated about the threaded nipple of the fuel canister 130 while maintaining threaded engagement with the threaded nipple of the fuel canister and used to make several punctures on the fuel canister 130 wall. Placing multiple piercings on the canister wall will ensure the canister is no longer pressurized and is ready for disposal or a recycle process.

Figure 17:
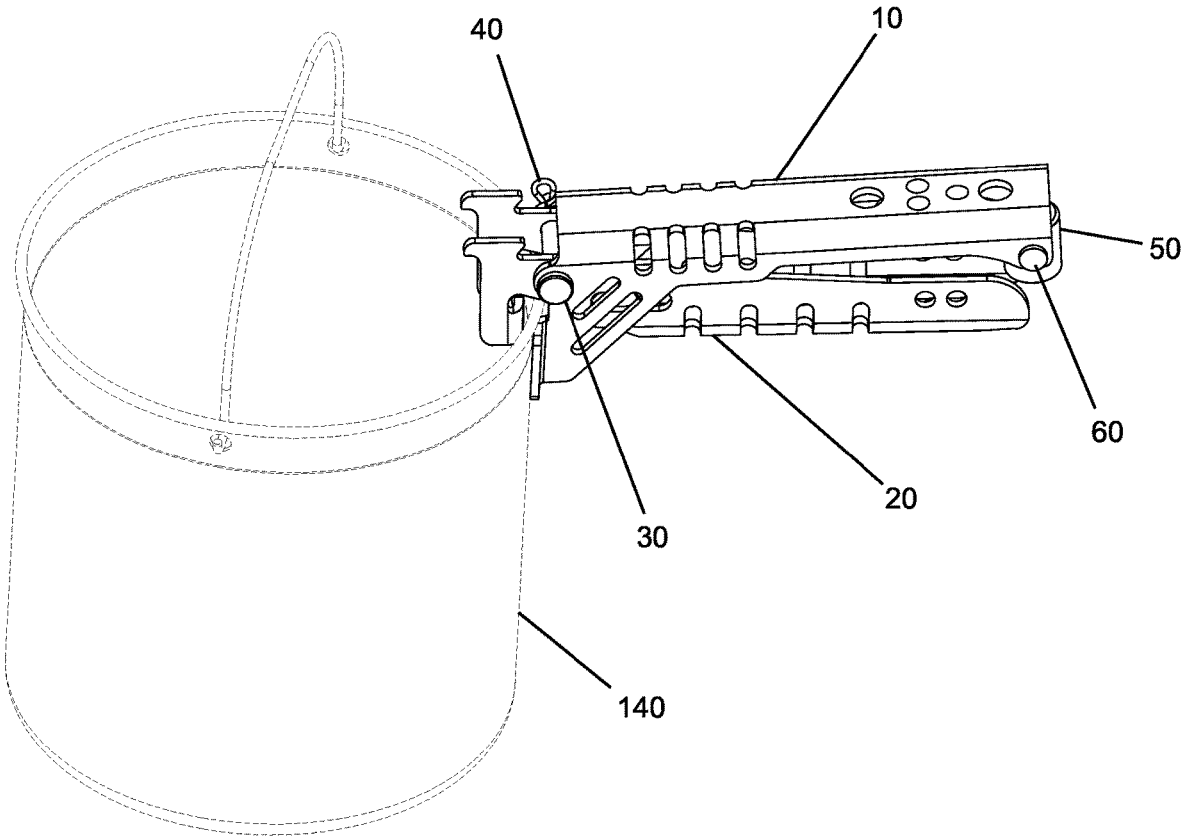
FIG. 17 shows a perspective view of the tool of FIG. 1 with a cooking pot according to an embodiment of the disclosure.

FIG. 17 illustrates a perspective view of an embodiment of the current disclosure in the closed configuration engaged on a camping pot 140. The upper handle 10 and lower handle 20 pivot around head axis pin 30 allowing the head to pinch or squeeze the wall of a pot. This view also illustrates the puncture tool being covered by the lower handle 20, thus providing a safe hand placement for the user to hold while gripping the camping pot 140.

Figure 18:
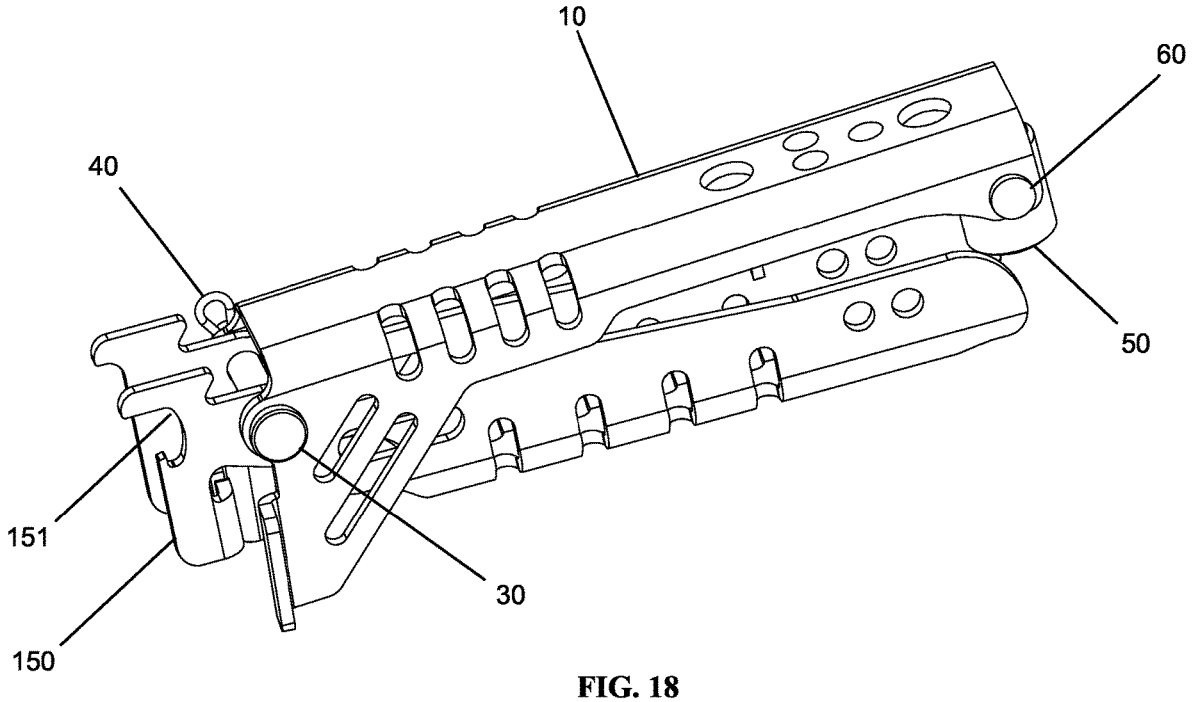
FIG. 18 shows a perspective view of a tool according to an embodiment of the disclosure.

FIG. 18 illustrates a perspective view of another embodiment of the current disclosure in the closed configuration which further includes a bottle opener feature 151. The lower handle 150 may have other designs and novel features built into its structure.

Figure 19:
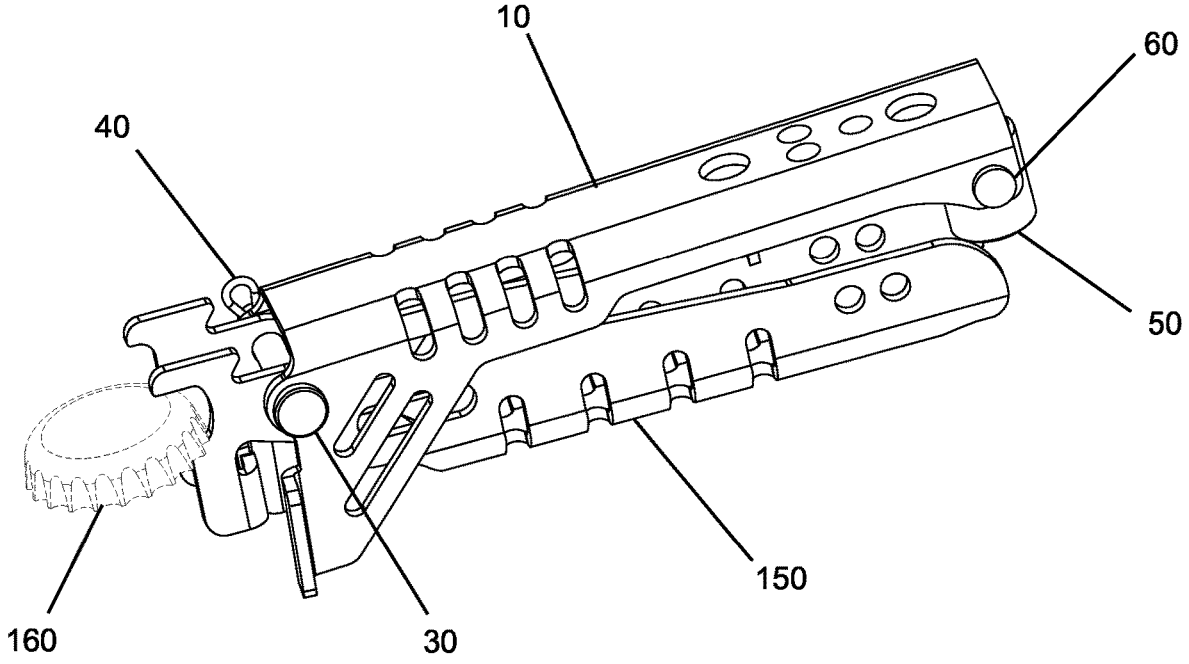
FIG. 19 shows a perspective view of the tool of FIG. 16 with a bottle cap according to an embodiment of the disclosure.

FIG. 19 illustrates a perspective view of FIG. 16 with a bottle cap 160 situated within the bottle opening feature of the lower handle 150. The head of the handle may be used to engage with a beverage bottle and pry-off bottle cap 160 to remove the bottle cap 160.

Use of language such as "at least one of X, Y, and Z," "at least one of X, Y, or Z," "at least one or more of X, Y, and Z," "at least one or more of X, Y, or Z," "at least one or more of X, Y, and/or Z," or "at least one of X, Y, and/or Z," are intended to be inclusive of both a single item (e.g., just X, or just Y, or just Z) and multiple items (e.g., {X and Y}, {X and Z}, {Y and Z}, or {X, Y, and Z}). The phrase "at least one of" and similar phrases are not intended to convey a requirement that each possible item must be present, although each possible item may be present.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. For example, it will be understood that embodiments of the invention may be made from a variety of different materials.

The invention claimed is:

1. A multi-use utility tool, comprising:

an upper handle comprising:

a canister connector;

a puncture device;

at least one upper handle surface configured to contact a container;

a lower handle having at least one lower handle surface configured to contact a container, wherein the multi-use utility tool has a closed configuration where the lower handle is pivotally connected to the upper handle and configured to releasably connect the at least one upper handle surface and at least one lower handle surface to a container, and wherein the multi-use utility tool has an open configuration where the canister connector is releasably attached to a fuel canister.

2. The multi-use utility tool of claim 1, wherein the puncture device is configured to puncture the fuel canister in the open configuration.

3. The multi-use utility tool of claim 1, wherein the canister connector is pivotally connected to the upper handle.

4. The multi-use utility tool of claim 1, wherein the canister connector is a threaded connector.

5. The multi-use utility tool of claim 1, wherein the canister connector comprises a center stem configured to release fuel from the fuel canister.

6. The multi-use utility tool of claim 1, further comprising a pin pivotally connecting the upper handle to the lower handle.

7. The multi-use utility tool of claim 6, wherein the pin is removed in the open configuration, wherein the upper handle is separated from the lower handle in the open configuration.

8. The multi-use utility tool of claim 6, wherein the lower handle is rotated about an axis of the pin in the open configuration such that the canister connector can releasably attach to the fuel canister.

9. The multi-use utility tool of claim 1, wherein the upper handle further comprises a top portion and two sidewall portions.

10. The multi-use utility tool of claim 9, wherein the puncture device is integrally formed in the top portion and wherein the puncture device extends distal to the two sidewall portions.

11. A releasable container handle, comprising:

A first handle body;

a cavity formed in the handle body;

a gripping portion located at one end of the first handle body, wherein the gripping portion is configured to removably grip a container;

a canister connector pivotally mounted within the cavity, wherein the canister connector is configured to releasably attach to a fuel canister;

a puncture tool located within the cavity, wherein the first handle body is configured to pivot about the canister connector to puncture the fuel canister with the puncture tool; and a second handle body pivotally connected to the first handle body, wherein the gripping portion comprises at least one first surface defined by the first handle body and at least one second surface defined by the second handle body.

12. The releasable container handle according to claim 11, wherein the second handle body is removably connected to the first handle body.

13. The releasable container handle according to claim 11, wherein a second cavity is formed in the second handle body, and wherein the canister connector and the puncture tool are located within the second cavity.

14. The releasable container handle according to claim 11, wherein the puncture tool is mounted within the cavity.

15. The releasable container handle according to claim 11, wherein the puncture tool is formed in the first handle body.

16. The releasable container handle according to claim 11, wherein the gripping portion comprises a first flange formed in the first handle body and a second flange formed in the first handle body.

17. The releasable container handle according to claim 16, wherein the first flange defines a first surface and wherein the second flange defines a second surface.

18. The releasable container handle according to claim 11, wherein the canister connector is a threaded connector.

19. The releasable container handle according to claim 11, wherein the canister connector comprises a center stem configured to release fuel from the fuel canister.

* * * * *